United States Patent [19]

Speer

[11] 4,212,284

[45] Jul. 15, 1980

[54] PNEUMATICALLY-OPERATED BALL PROJECTING DEVICE

[76] Inventor: Richard Speer, Oak Hall, Ware Neck, Va. 23178

[21] Appl. No.: 894,162

[22] Filed: Apr. 6, 1978

Related U.S. Application Data

[63] Continuation-in-part of Ser. No. 764,197, Jan. 31, 1977, Pat. No. 4,094,294.

[51] Int. Cl.[2] ..... F41F 1/04

[52] U.S. Cl. ..... 124/56; 124/41 C

[58] Field of Search ..... 124/41 R, 41 C, 51 A, 124/56, 71, 72, 73, 74, 75, 76; 273/26 D, 29 A, 30; 56/328 R, 332

[56] References Cited

U.S. PATENT DOCUMENTS

| | | | |
|---|---|---|---|
| 3,261,341 | 7/1966 | Merz | 124/74 |
| 3,584,614 | 6/1971 | Horvath | 124/56 |
| 3,664,104 | 5/1972 | Jamshidi | 56/332 |
| 3,756,001 | 9/1973 | Macidull | 56/328 R |
| 3,855,988 | 12/1974 | Sweeton | 124/56 |
| 3,905,349 | 9/1975 | Nielsen et al. | 124/56 X |
| 3,990,426 | 11/1976 | Stokes | 124/56 |
| 4,027,646 | 6/1977 | Sweeton | 124/56 |
| 4,094,294 | 6/1978 | Speer | 124/56 |

*Primary Examiner*—Richard T. Stouffer
*Attorney, Agent, or Firm*—Barry G. Magidoff

[57] ABSTRACT

A pneumatically-operated ball projecting device is provided wherein the muzzle velocity of the projected ball is determined by a pneumatically-operated detent in the barrel of the device. The detent holds the ball within the barrel until a predetermined air pressure is built up behind the ball, causing the detent to collapse, permitting the ball to be projected out of the barrel. Varying the pressure required to collapse the detent directly varies the muzzle velocity.

29 Claims, 21 Drawing Figures

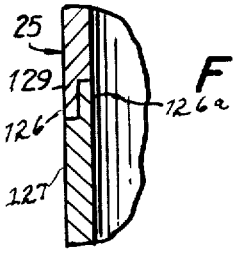
FIG. 4A
FIG. 4
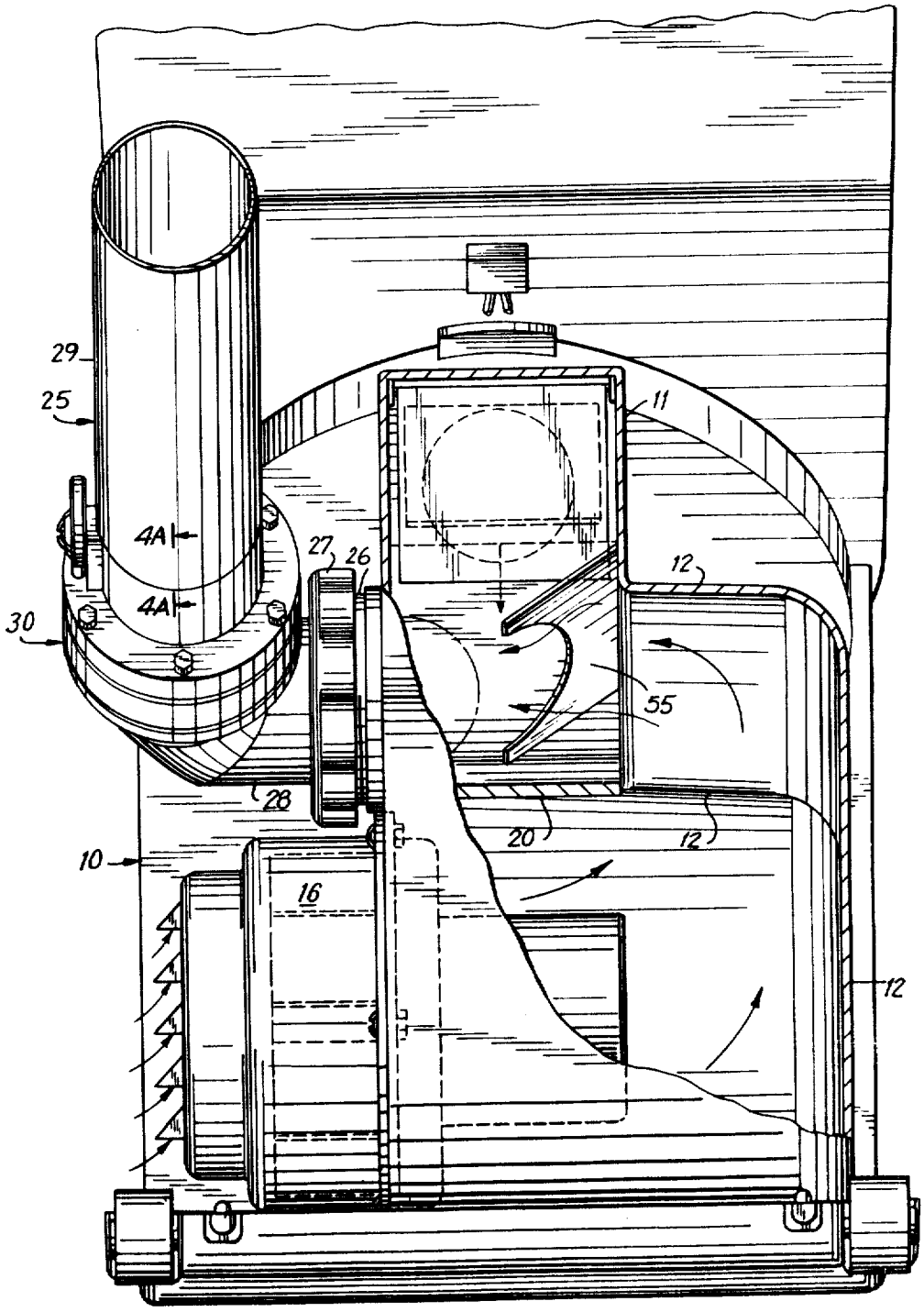

PNEUMATICALLY-OPERATED BALL PROJECTING DEVICE

This is a continuation-in-part of copending application Ser. No. 764,197, filed on Jan. 31, 1977, and now U.S. Pat. No. 4,094,294.

This invention is directed to a device for the projecting or "throwing" of articles, and in particular to an improved, pneumatically operated projecting device for the throwing of balls, such as tennis balls, baseballs and the like.

The prior art is well acquainted with a variety of pneumatically operated devices for the projecting or throwing of a wide variety of balls, including relatively heavy baseballs, medium weight tennis balls, or ping pong balls. Such devices also include means for providing a supply of such balls for automatically feeding the pneumatic projectile device with a large number of balls to be projected at a pre-defined rate. Such devices generally comprise a means for developing pneumatic pressure, generally air pressure, means to feed a ball into a barrel, behind which the gas pressure is developed, and a releasable detent means in the barrel for restraining the ball until a predetermined pressure has been developed behind the ball for providing the desired velocity. Such detent means have included spring-loaded detent means such as buttons, or elastic members, or collars, located within or at the end of the barrel. Reference is made, for example, to U.S. Pat. Nos. 2,574,408; 3,009,703; 2,357,951; 3,584,614; 3,905,349; and 3,855,988. Some of these patents also provide means for varying the speed of the ball as it is projected from the barrel. For example, Sweeton, U.S. Pat. No. 3,855,988, describes means for varying the speed of the ball by adjusting the bias spring pressure acting against the detent button, or by varying the pressure of the air behind the ball after the ball has passed the detent area.

Such a detent button type means provides a detent which unfortunately permits the leakage of the pressurized gas between the ball and the remaining portion of the barrel. A tighter seal, is of course obtained utilizing an elastic sleeve, such as is shown in U.S. Pat. No. 3,905,349. However, the velocity of the ball projected through the sleeve in this patent to Nielson et al, is not varied by varying the detention force exerted by the detent means, but rather by a more complicated system of varying the air flow behind the ball.

In accordance with the present invention, there is provided a device for projecting a ball by pneumatic means, through a barrel. There is provided inflated means in the barrel for transiently restraining the movement of a ball therethrough until a predetermined pressure is developed behind the ball, the detent means being automatically deflated upon the achievement of such pressure so as to permit the passage of the ball at the desired velocity. Preferably, the pressure within the detent means increases as the pressure behind the ball increases, until deflation occurs at the predetermined pressure. The inflated detent means is relaxed by opening a preferably pneumatically-operated exhaust valve between the interior of the detent means and atmosphere; the pressure on the valve is increased as the pressure behind the ball is increased. Upon the attainment of the predetermined pressure, the exhaust valve is moved into the open position, thus permitting the inflated detent to deflate and collapse, sufficiently to immediately permit the projection of the ball under the force exerted by the gas pressure therebehind through the barrel and out at the desired velocity.

This invention further provides means for pneumatically varying the resistance provided by a detent means subject to the gas pressure exerted upon the ball to be projected.

A further understanding of the invention and the preferred embodiments for achieving the desired objects are set forth in the embodiments illustrated in the accompanying drawings. The illustrated embodiments, however, are intended merely to be exemplary of the presently known preferred means for carrying out the invention, and are not intended to be exclusive of the full scope of the invention.

Referring to the drawings:

FIG. 1 is a perspective view of the complete apparatus in operation;

FIG. 1*a* is a perspective view of the complete apparatus in its portable carrying condition;

FIG. 4 is a partially broken away front elevation view of the complete device;

FIG. 4A is a sectional view along lines 4A—4A of FIG. 4;

Figure 1:
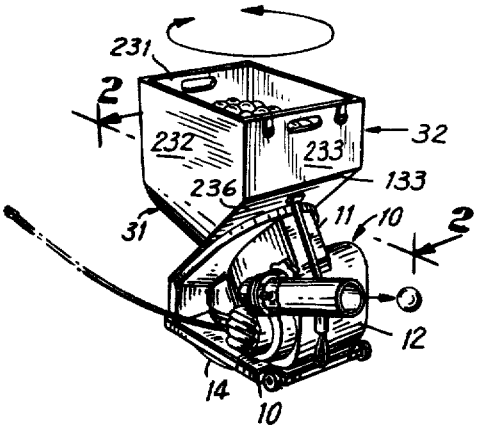
Figure 1A:
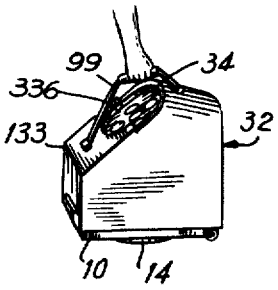
Figure 3:
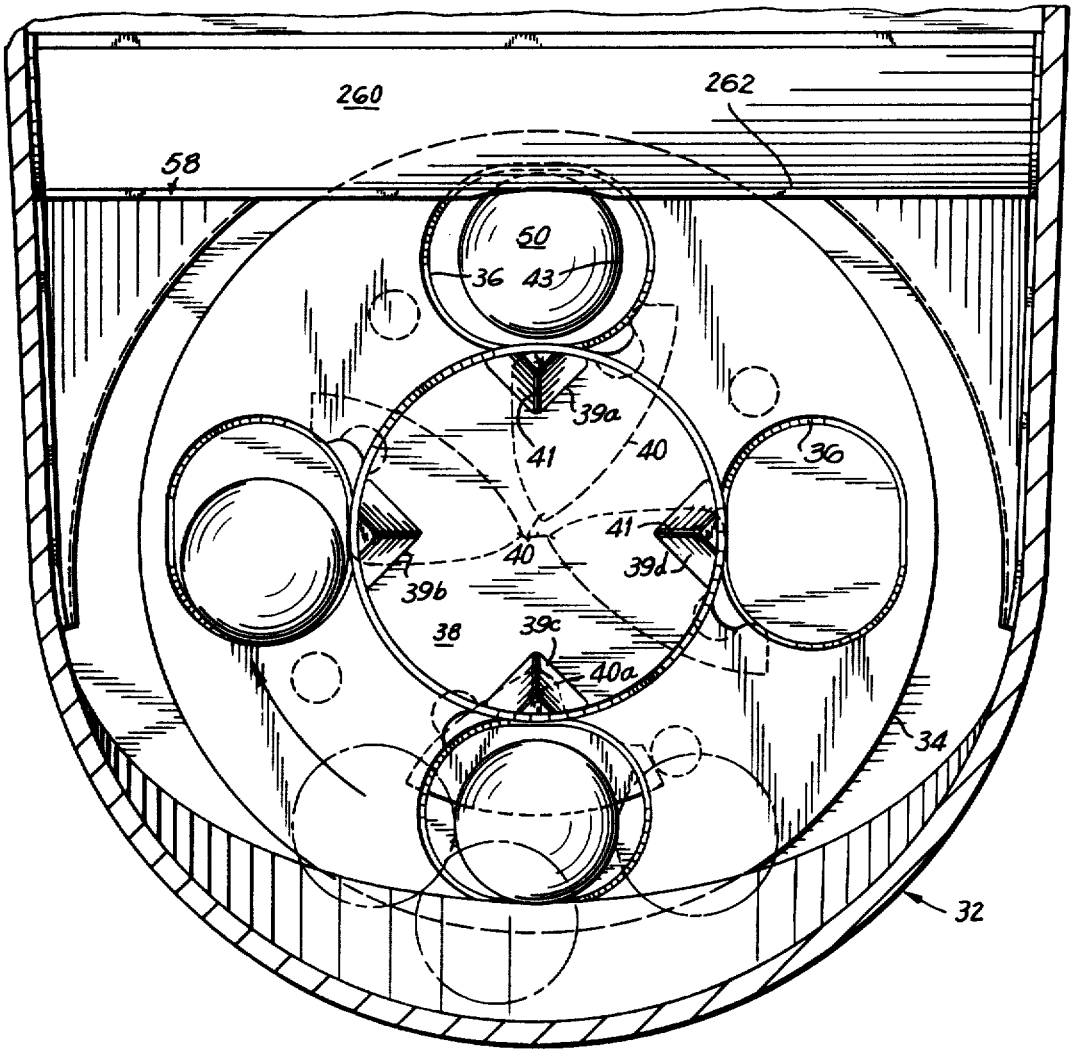
FIG. 3 is a sectional view taken on line 3—3 of FIG. 2.
Figure 2:
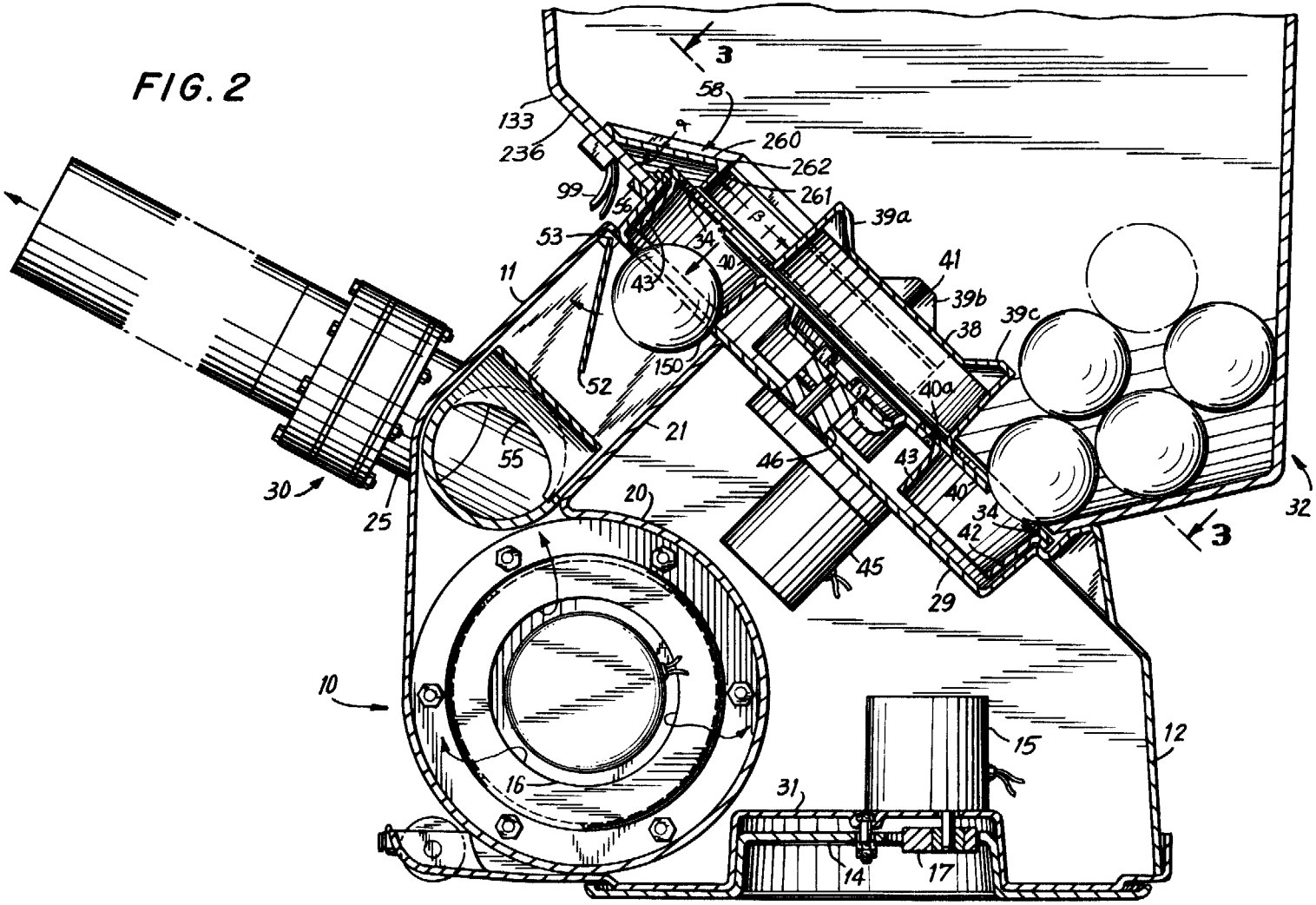
FIG. 2 is an enlarged side elevation view along line 2—2 of FIG. 1.
Figure 5:
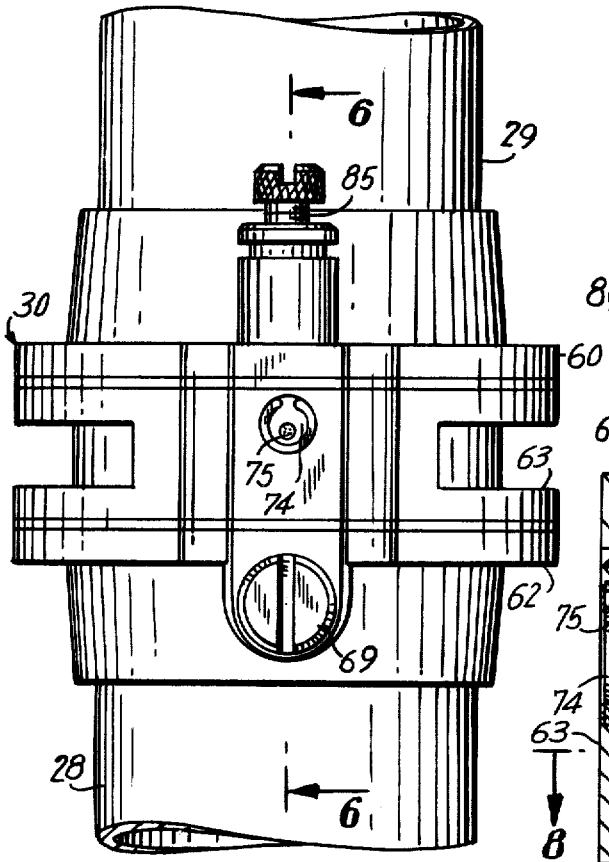
FIG. 5 is an enlarged side elevation view of a portion of the barrel of the projecting device.
Figure 6:
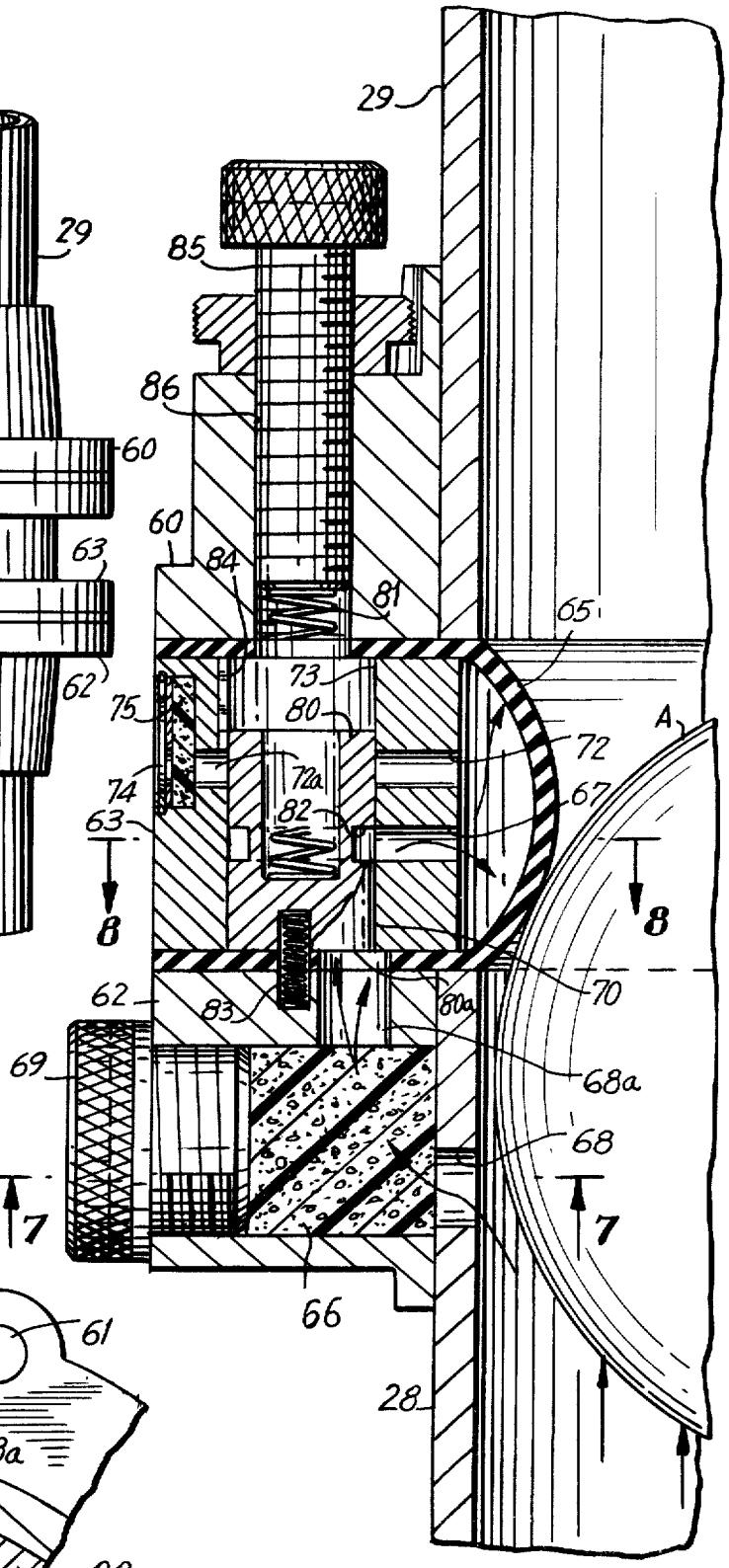
FIG. 6 is a sectional view along line 6—6 of FIG. 5.
Figure 7:
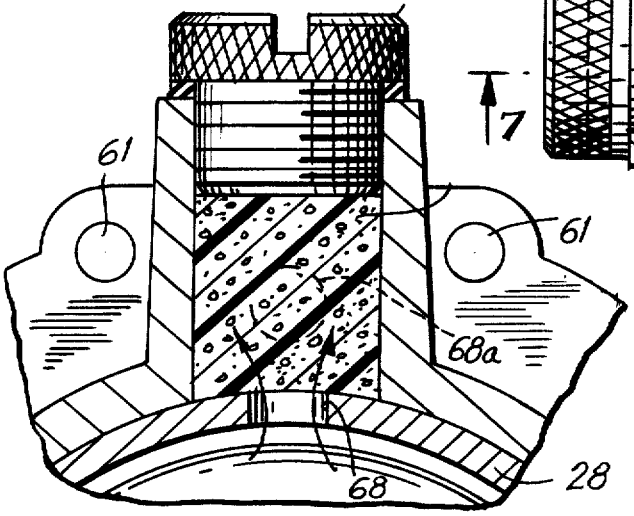
FIG. 7 is a sectional view taken along line 7—7 of FIG. 6.
Figure 9:
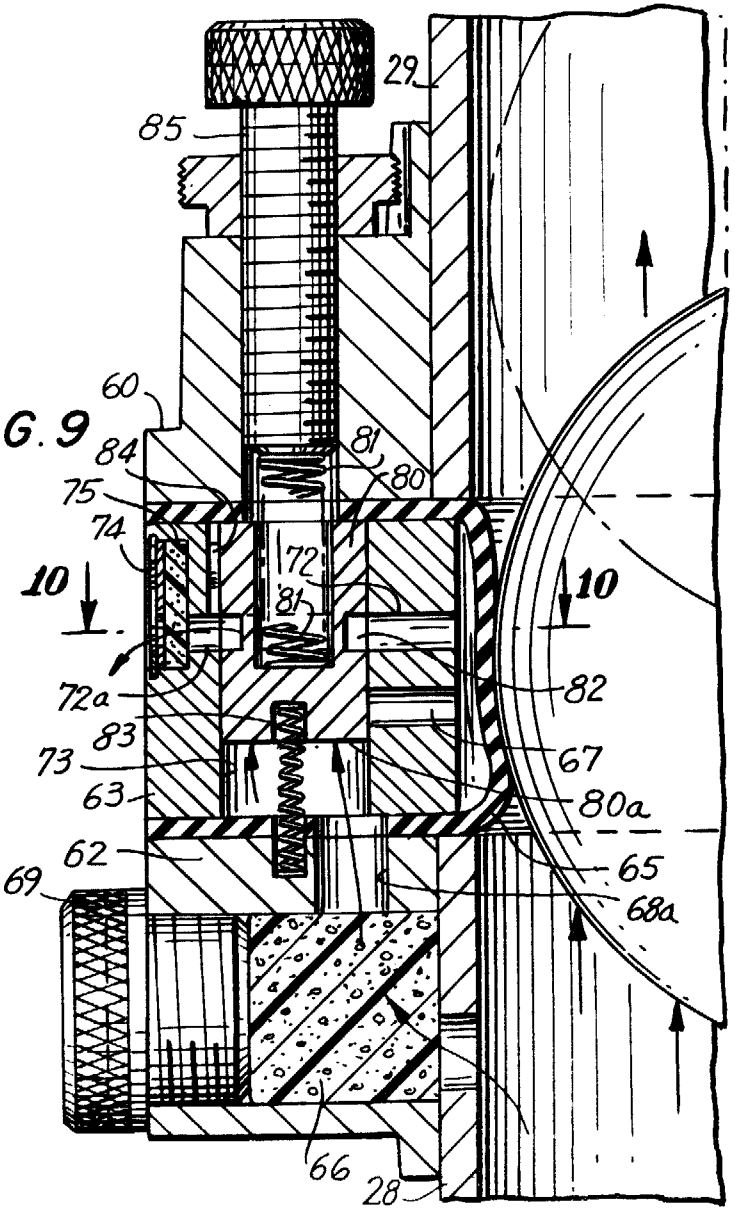
FIG. 9 is the same view as FIG. 6 showing the ball and retention means in a projecting position.
Figure 8:
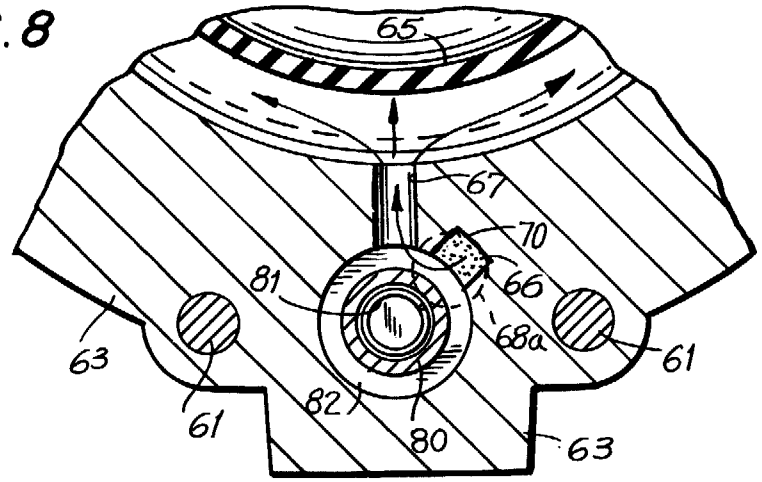
FIG. 8 is a sectional view taken along line 8—8 of FIG. 6.
Figure 10:
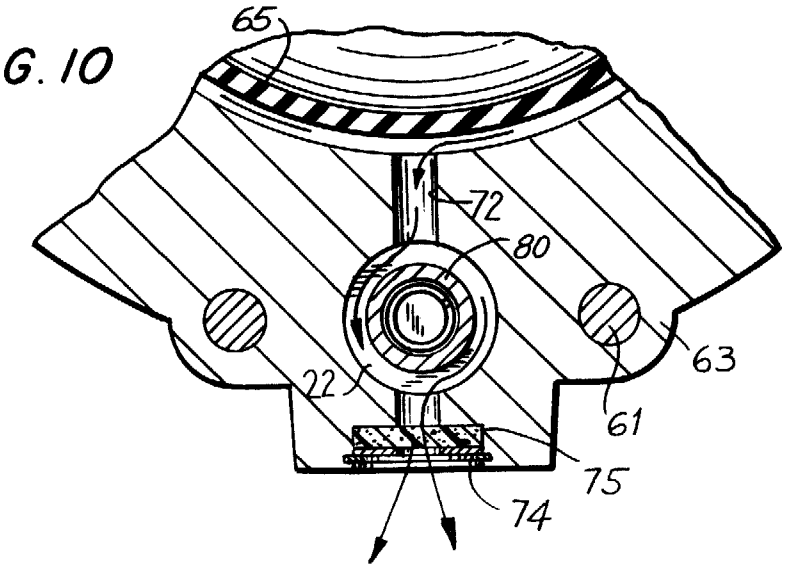
FIG. 10 is a sectional view taken along line 10—10 of FIG. 9.
Figure 11:
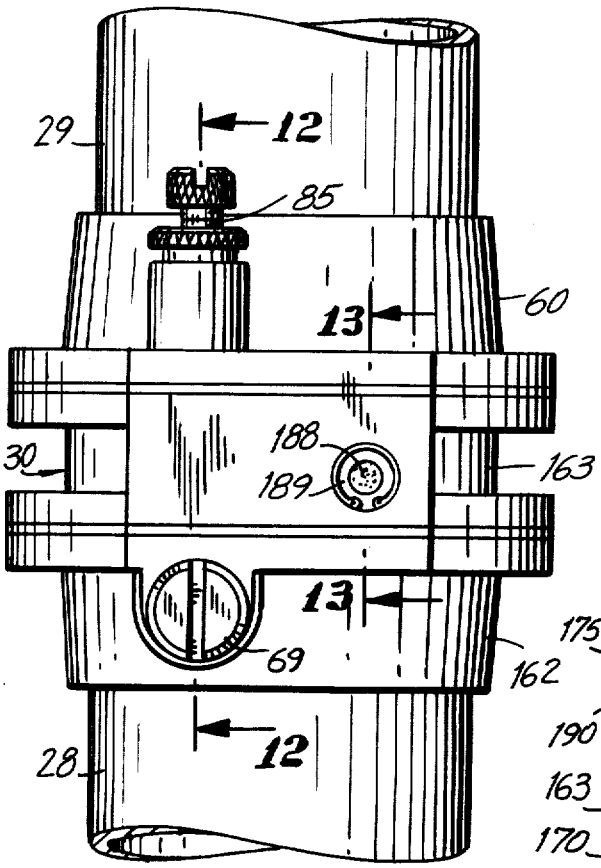
FIG. 11 is an enlarged side elevation view of portion of the barrel of an alternative embodiment of the projecting device.
Figure 12:
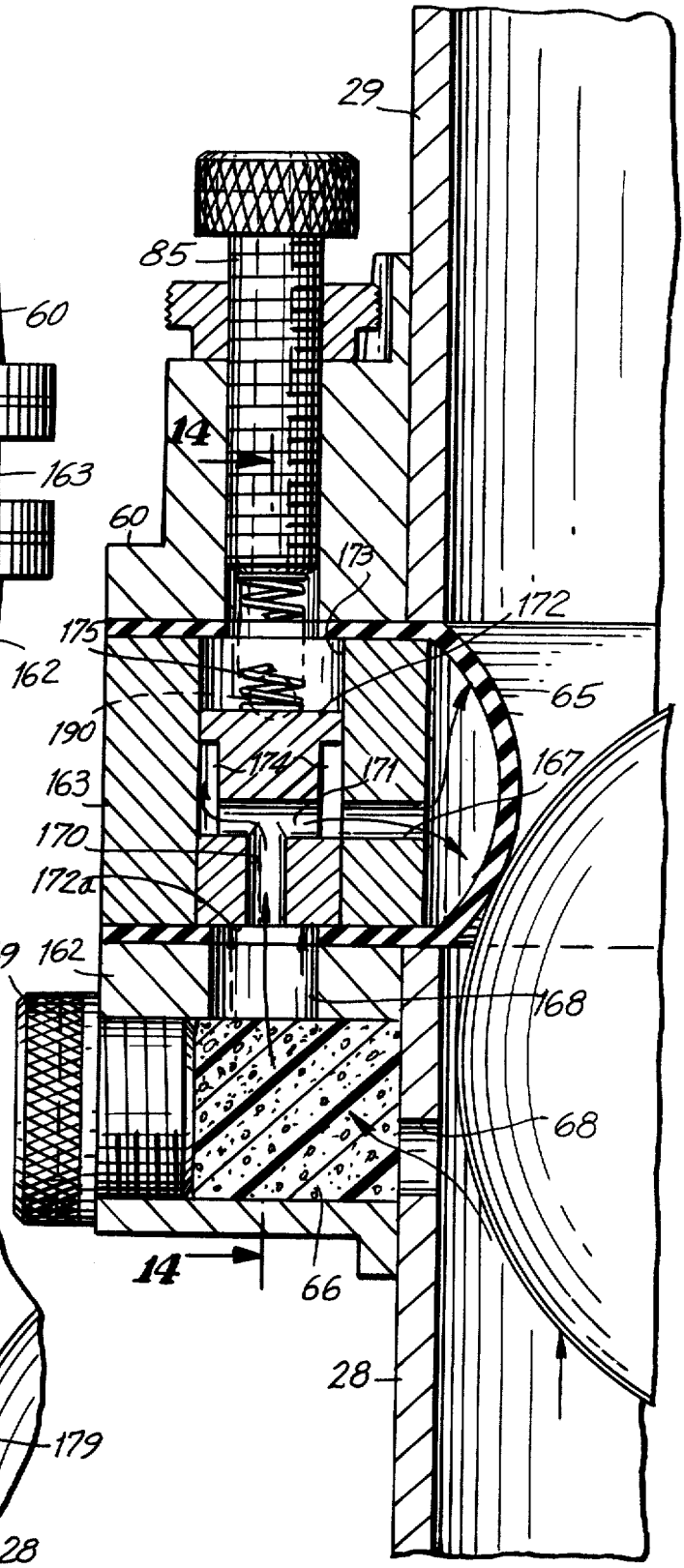
FIG. 12 is a sectional view taken along line 12—12 of FIG. 11.

Referring to the drawings, FIGS. 1 through 4 depict the overall construction of a preferred tennis ball serving machine in accordance with the present invention. Such a machine comprises, generally, a body portion, generally indicated by the numeral 10, including an air chamber lower portion 12, which in turn is in fluid flow connection with the output end of a blower 14, and an upper ball chute portion 11.

The angled barrel, generally indicated by the numeral 25, is rotatably connected to the body 10 and secured by a knurled nut 27 to a complementarily threaded barrel stub 26. The inner elbow portion 28 is connected to the outer barrel portion 29 of the barrel 25 by a flange member, generally indicated by the numeral 30. The barrel stub 26 is formed in the upper portion of the air chamber 12, substantially at the interface with the ball chute portion 11.

Internal diameter of the barrel is to be determined by the range of ball sizes within the nominally standardized range. For example, tennis balls vary depending upon manufacturing tolerances, age and degree of use, or wear. The barrel in a tennis ball service device, in accordance with this invention, should be sized to provide operating clearance for the largest new tennis ball.

The outer barrel 29, is of a variable length, the length being increased or decreased by the implacement or removal of barrel sections which are preferably secured by a locking taper joint or a threaded joint. Barrel section 127 is secured to the flange 30, and has at the end thereof a male tapered portion 126*a*. A second barrel portion 129 has an internal matching tapered portion 126 formed within one end thereof, capable of being secured to the male portion 126*a* of barrel 129. The second end of barrel portion 129 also has a male tapered portion which can be secured to an additional barrel length, the length of the barrel being capable of being increased indefinitely, merely by the addition of further barrel portions, or of barrel portions of greater length.

It is clear that in addition tc tapered or threaded connections, other means for connecting additional barrel lengths are well-known in the art and can be equally well used. It is preferred, that the interior diameter of the barrel remain substantially constant along its length, such that the addition of further barrel pieces, such as extension piece 127, be connected in a manner so as to maintain a constant internal diameter of the barrel.

The remaining portions of the mechanism and construction of the interior of the body 10 of the ball projecting device of this invention is substantially as described in copending application Ser. No. 764,197, filed Jan. 31, 1977. Those portions of the above-identified copending application which describe the interior of the body portion and its operation are incorporated herein by reference, as if fully set forth herein.

The improved means for controlling the velocity of a ball projected from the barrel 25 are shown in FIGS. 5 through 19. In construing the following description of the preferred embodiments of this invention, it should be noted that the word "ball" is utilized as a preferred example of, and as a simple symbol for, any article capable of being projected from a barrel. It is quite clear that the outer circumference of the projectile, and the interior cross-sectional shape of the barrel should be geometrically similar. Preferably, of course, the barrel has a circular interior cross-section and the projectile has a circular exterior circumference. Even more preferably, and most commonly, the projectile will be a substantially spherical ball, such as a tennis ball.

A first preferred embodiment of this invention is depicted in FIGS. 5 through 10. This embodiment generally comprises means for increasing the pressure within the detent means as the pressure behind the projectile increases, and for limiting the pressure within the detent means to a certain level by closing a valve connecting the detent means to the source of fluid pressure. A second valve means is opened to permit exhausting the air within the detent means to atmosphere at the desired predetermined pressure. In this embodiment, a single valve member is utilized for initially closing off the valve means between the detent volume and the pressure supply and subsequently opening the exhaust valve, or vent, between the detent volume and atmosphere.

In this first preferred embodiment, the flange unit 30 comprises three segments: an outer flange portion 60, rigidly secured to the outer barrel portion 29, an inner flange portion 62, rigidly secured to the inner barrel portion 28, and a central flange portion 63, firmly clamped between the inner and outer flange members 62, 60. An annular bladder or membrane 65, having flared outer ends, is clamped at its outer ends between the outer flange 60 and central flange 63 and inner flange 62 and central flange 63, respectively, so as to define a detent volume with the internal circumference of the central flange portion 63. The flange portions 60, 62, and 63, are held together as the single flange unit 30 by the clamping effect provided by a plurality of threaded nut-and-bolt-type fasteners 61. If desired, a portion of the outer ends of the membrane 65 can additionally be adhesively secured, preferably to the central flange portion 63, at its inner and outer ends, respectively.

A detent pressure channel 68 is formed through the inner barrel member 28, opening into the interior 68*a* of the inner flange portion 62 which in turn is connected through an opening through an end of the membrane 65 into the valve chamber 73 formed within the central flange portion 63. The valve chamber 73 is in turn connected, through a detent pressure channel 67 formed through the central flange portion 63, to the detent volume defined by the membrane 65.

A spool valve member 80, having a lower pressure surface 80*a*, is slidably held within the valve chamber 73. A biasing helical spring member 81 is inserted within a concavity in the outer portion of the spool valve member 80 extending outwardly into contact with the lower end of a screw-threaded, bias control stem 85. A weight balancing helical spring 83 is preferably inserted within a concavity in the inner portion of the spool valve member 80 extending inwardly into an aligned concavity in the inner flange 62. An annular notch, defined by concave surfaces 82, is formed about the circumference of the valve spool member 80, at a level such that when the valve member 80 is in the position of FIG. 6, the annular notch is in line with the pressure channel 67.

A pressure channel, or key slot, defined by concave surface 70, is formed in the inner circumference of the valve chamber wall 73, extending from the inner end adjacent pressure channel 68*a* outwardly to a level even with pressure channel 67, but angularly displaced therefrom. The key slot 70 connects with annular notch 82 when the valve member 80 is in the position of FIG. 6. Vent channels 72 and 72*a* extend radially through the side walls of the central flange portion 63, connecting the valve chamber 73 with the detent volume and atmosphere, respectively.

A vent channel, or key slot, defined by concave surface 84, is formed in the inner circumference of the valve chamber 73, extending from the outer end of the central flange portion 63 to the vent channel 72*a*, to avoid any pressure buildup beyond the outer face 80*b* of the valve member 80.

There is clearance between the circumference of the valve member 80 and the valve chamber wall 73, in order to avoid sticking or jamming of the member 80. The slight air leakage has been found not to significantly interfere with the operation of the device and further has the effect of flushing out any dust that may otherwise accumulate.

A pressure filter 66 is placed within the inner flange portion 62, held in place by filter plug 69. The filter plug 69 maintains a pressure-tight fit so as to prevent loss of pressure between the inner barrel 28 and the detent volume defined by membrane 65. The filter means can be any means for removing abrasive particles from the air passing from the barrel 28 into the detent volume. A preferred material is a reticulated, or open pore, polyurethane foam material cut to the proper shape. Such material can be removed and either cleaned as by washing with water, or replaced with a fresh filter. A second, exhaust filter 75, is placed in the expanded portion of the vent channel 72*a*, to eliminate the intake of any undesirable particles from the atmosphere which might interfere with the action of the spool valve member 80.

The bias control stem 85 is threadedly secured, to the outer flange portion 60. The control stem 85 can thus be moved axially towards and away from the spool valve member 80, thereby compressing or releasing the bias spring 81, and thereby increasing or decreasing, respectively, the bias force on the spool valve 80 towards the inner flange portion 62.

The detent membrane 65 is preferably formed of a variety of resiliently elastic materials, which are also inherently impermeable to air, or other gases, such as natural rubber or synthetic rubbers. Most preferably, the membrane 65 is biased towards the inflated condition, e.g., shown in FIG. 6, by the natural elasticity of the membrane material.

In operation, a ball is fed from the hopper 32, on the body portion 10, eventually reaching the inner barrel portion 28. The operation of the feeding mechanism in the body portion is more fully described in copending application Ser. No. 764,197, supra. Upon reaching the detent membrane 65, the ball is restrained from proceeding outwardly along the barrel. The spool valve member 80 is in the position shown in FIG. 6, such that air pressure within the inner barrel 28 is transmitted via pressure channel 68 and 68*a*, passing through the filter 66, along the slot 70, and annular notch 82, and through the pressure channel 67 into the detent volume behind the membrane 65.

The ball, designated by the letter A, forms a substantially pressure-tight seal with the detent 65, thereby causing a gradual increase in pressure in the inner barrel 28 behind the ball, but simultaneously also increasing the pressure within the detent volume, thus serving to prevent the ball A from passing through the detent membrane 65. The pressure within the inner barrel 28 also acts upon the inner surface 80*a* of the spool valve member 80, tending to push the spool valve member 80 outwardly against the biasing action of spring 81. Fluid, or fluid pressure, is not quickly transmitted around the spool valve 80 and thus there is a pressure drop between the surface 80*a* and the outer surface of the spool valve member closest to the stem 85. When the force acting against surface 80*a* increases beyond the force exerted by biasing spring 81 the spool valve member 80 is moved outwardly towards the stem 85, eventually disengaging annular notch 82 out of fluid flow engagement with pressure vent 67. This seals off pressure vent 67 from the angularly displaced pressure key slot 70, which had previously led into the annular notch 82 and then out through slot 67. Thus, the pressure within the detent volume can no longer be increased by direct fluid flow from the inner barrel portion 28. After the detent volume 65 is sealed off from the inner barrel 28 by movement of the spool valve member 80, the spool valve member continues to slide axially towards the stem 85, against the biasing action of the spring, until the annular notch 82 is juxtaposed in fluid flow position with the vent slots 72 and 72*a*. At this point, the pressure within the detent volume 65 is immediately released to atmosphere, permitting the substantially immediate deflation of the membrane 65 into the position shown in FIG. 9, thereby removing the restraint to the ejection of the ball by the pressure in inner barrel portion 28.

As the ejection velocity of the ball is directly related to the pressure in inner barrel 28 at the moment of ejection, the muzzle velocity can be regulated by varying that inner barrel pressure. Such pressure is in turn varied by the control of the bias spring, so as to increase or decrease the pressure required to move the spool valve member from the pressurizing position shown in FIG. 6 to the venting position shown in FIG. 9. Accordingly, by moving the stem 85 outwardly, by rotating about its threads, the force exerted by bias spring 81 is decreased and a lower pressure, and therefore lower muzzle velocity is obtained. By screwing the valve stem into the outer flange portion 60, and thus compressing the bias spring 81, the force exerted on the spool valve member 80 is increased, thus requiring a greater pressure within the inner barrel portion 28 to move the spool valve member 80 to the venting position, and thus ultimately increasing the muzzle velocity of the projected ball.

The weight balancing spring 83 is preferably so designed that when there is no force exerted by bias spring 81 on the valve member 80, the valve member is balanced in venting position. This permits more accurate adjustment at lower velocities.

After the ball has passed has passed through the detent means and out the barrel, the resilient membrane in its most preferred embodiment of an elastic material snaps back into position, thereby restraining the next ball fed from the body portion 10 into the inner barrel portion 28 of this device. The spool valve member 80 also immediately moves back to its pressurizing position once the pressure is released, under the action of the biasing spring 81. Thus, the system is ready for the detention and ultimate projection of the next ball passing from the inner barrel portion 28.

A second preferred embodiment of an inflatable pneumatically controlled detent means for a ball projection device is depicted in the Drawings of FIGS. 11 through 19. Although this second embodiment operates in substantially the same manner, utilizing the same type of inflatable detent membrane 65, two independent valves are used for the pressure valve and the vent valve means, respectively. Each valve has a separate bias means, but only the pressure valve has a control means for varying the force exerted by the bias means. If desired, however, control means can also be provided for the vent valve member. Generally, it is believed, that this additional control means makes the operation of the device unnecessarily complicated. In any event, the desired effect is achieved, wherein the exhaust vent valve does not open until a finite time after the pressure valve has closed.

The lower flange portion 162 of the second embodiment is almost of the same construction as the lower flange portion in the first embodiment described above. That is, a pressure vent 68 is formed through the lower barrel portion 28 connecting the interior of the lower flange portion to the interior of the inner barrel portion. A filter 73 is placed within the inner flange portion 162 and a pressure vent 168 connects the interior flange portion 162 with the valve chamber 173 within the middle flange portion 163. A threadedly secured, gas pressure tight plug 69 maintains the filter 73 in place, and prevents the loss of fluid or pressure from the system.

The valve chamber 173 within the central flange portion 163 is of substantially cylindrical cross-section having a substantially constant diameter along its entire length. The upper flange portion 60 is substantially identical to the upper flange portion in the first embodiment, containing the threaded bias stem 85.

A spool valve member 172, having a lower pressure face 172*a*, is slidably held within the valve chamber 173. A bias spring 175 extends between the lower end of the control stem 85 and the upper surface of the spool 172.

A vent valve dog-leg pressure channel 190 is formed within the central flange portion 163 extending from the outer interior surface of the valve chamber 173 inwardly towards the inner flange portion 162.

An annular notch, defined by concave surfaces 174, is formed about the circumference of the valve member 172 in such a position that when the notch 174 is in connecting relationship with detent pressure channel 176, it is out of connecting relationship with vent valve pressure channel 190.

An axial spool pressure channel 170 extends from the pressure surface 172*a* through the spool valve member 172 towards the mid-point, to connect with radial spool pressure channel 171. The radial pressure channel 171 opens into the annular notch 174. A U-shaped pressure channel 192 is formed in the inner flange portion 162 connecting at one end with the pressure channel 190. The second end of the U-shaped channel 192 is sealed off by a flexible, fluid-tight diaphragm 179. A vent valve chamber 182 is formed within the central flange portion 163. At the outer end 182*a* of the vent valve chamber, a vent channel 194 connects the vent valve chamber to the detent volume defined by membrane 65. A cruciform port 195 distributes any gas passing from vent channel 194 to the corners of the outer portion of vent valve chamber 182*a*.

The inner end of vent valve chamber 182, i.e., that portion adjacent the inner flange portion 162, is sealed off from the vent channel 92 by the fluid impermeable flexible diaphragm 179. Juxtaposed in contact with the interior surface of the diaphragm 179 is a vent valve plunger 180, the other end of which supports a vent valve disc 186 which is preferably formed of a soft, elastic material, such as soft rubber. The inner surface of vent valve disc 186 rests upon valve seat 187. A vent valve bias spring 185 is in contact with and extends between the inner portion of the vent valve plunger 180 and the inwardly extending surface 181 of the vent valve chamber 182.

As in the first embodiment, described above, fluid filter 73 is provided between the inner barrel portion 25 and the pressure spool valve member 172, and exhaust filter 188 is provided between atmosphere and the vent valve. A bias control stem 85 is also provided to enable the operator to vary the bias force exerted by pressure valve bias spring 175. Although in the second embodiment depicted herein, bias control means are not provided for the vent valve bias means, such means can be provided if it is deemed desirable. However, such second bias control means are not believed to be usually necessary. The bias force exerted by bias spring 185 on the vent valve is preferably always lower than the biasing force exerted against the pressure valve member172; the bias spring 185 is primarily intended to stabilize the plunger 180. The primary biasing force against the vent valve is the pressure within the detent volume 65, as exerted against the outer surface of the valve disc 186. Preferably, the surface area of the diaphragm 179 exposed to the pressure from the vent channel 192 is greater than the surface area of the outer surface of the valve disc 186, to insure a fast opening of the vent valve as soon as the spool 172 connects with the pressure channel 190.

In operation, this second embodiment provides substantially the same effect as the first embodiment, i.e., the pressure valve between the detent volume and the inner barrel portion 28 closes, thereby sealing off the inner barrel portion, before the exhaust valve between the detent volume and atmosphere opens.

When the first of a plurality of tennis balls is fed to the inner barrel portion and abuts against the detent member 65, the pressure valve spool and exhaust valve spool are in the positions generally depicted by FIGS. 12 through 16. As the pressure behind the detained ball increases, the pressure within the detent volume defined by membrane 65 also increases as the pressure, and fluid, is transmitted through vents 68, 168, 170 and 167 (after passing through the filter 73) and the same pressure is exerted against the pressure surface 172*a* of valve spool 72. When the force exerted on surface 172*a* overcomes the bias action of spring 175, the valve spool 172 moves outwardly towards the control stem 85, moving the annular notch 174 out of juxtaposition with the channel 167, ultimately sealing off the detent volume 65 from the inner barrel portion 28. As the spool valve is moved further outwardly, the annular notch 174 is moved into juxtaposition with vent channel 190, thereby exposing the diaphragm 179 to the pressure in the inner barrel portion 25, via channels 190, 192. The pressure exerted against the first side of (the approximately 0.015 in. thick) diaphragm 179 is transmitted to the inner end of the exhaust valve plunger 180, moving the plunger about 0.045 in. against the spring 185 and the detent volume pressure exerted against the outer surface of valve 186, forcing the valve disc 186 to flex outwardly until it snaps off from its seat against valve surface 187, permitting the detent volume to immediately be deflated, permitting the detained ball to be projected from the barrel. The air exhausts from the detent volume via channels 194, 195, through the space formed between valve disc 186 and surface 187, when the plunger is lifted, through the valve chamber 182 and out exhaust vent 193, ultimately escaping through the filter 188. The filter 188 is held in place by snap ring 189 and prevents the intake of particles of grit from the atmosphere after the exhaust has been completed. The diaphragm 179 prevents any loss of pressure from the inner barrel portion 28, when the valve is open.

The cycle is then repeated by the feeding of the next ball from the hopper 20.

The valve disc 186 in the second embodiment described above, i.e., FIGS. 11 through 19, is shown as being made from a soft rubber or other flexible elastomer. In the configuration shown, the valve disc 186 need not be secured permanently to the plunger 180, but it is rather held in position against the valve seat 186 by a combination of gravity and the pressure in the detent volume, as transmitted through channel 194. Alternatively, it would be slightly preferable to have the valve disc 182 rigidly secured to, as by welding or by an adhesive, the plunger 180.

Figure 13:
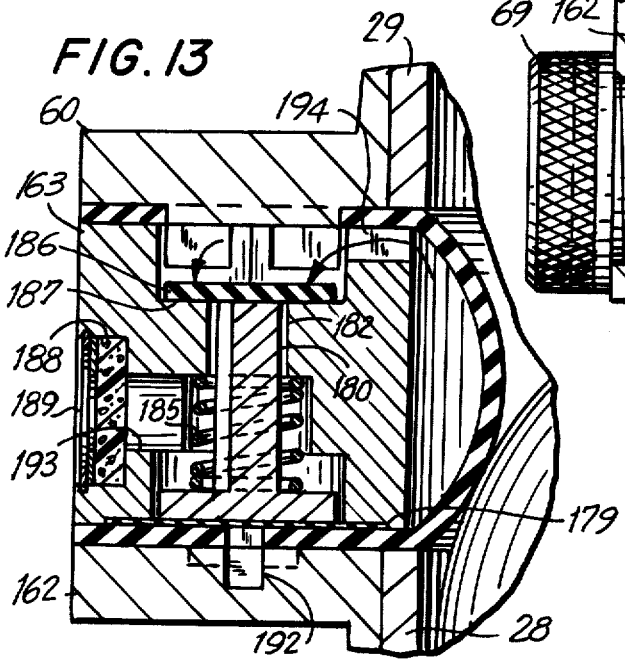
FIG. 13 is a sectional view taken along line 13—13 of FIG. 11.
Figure 14:
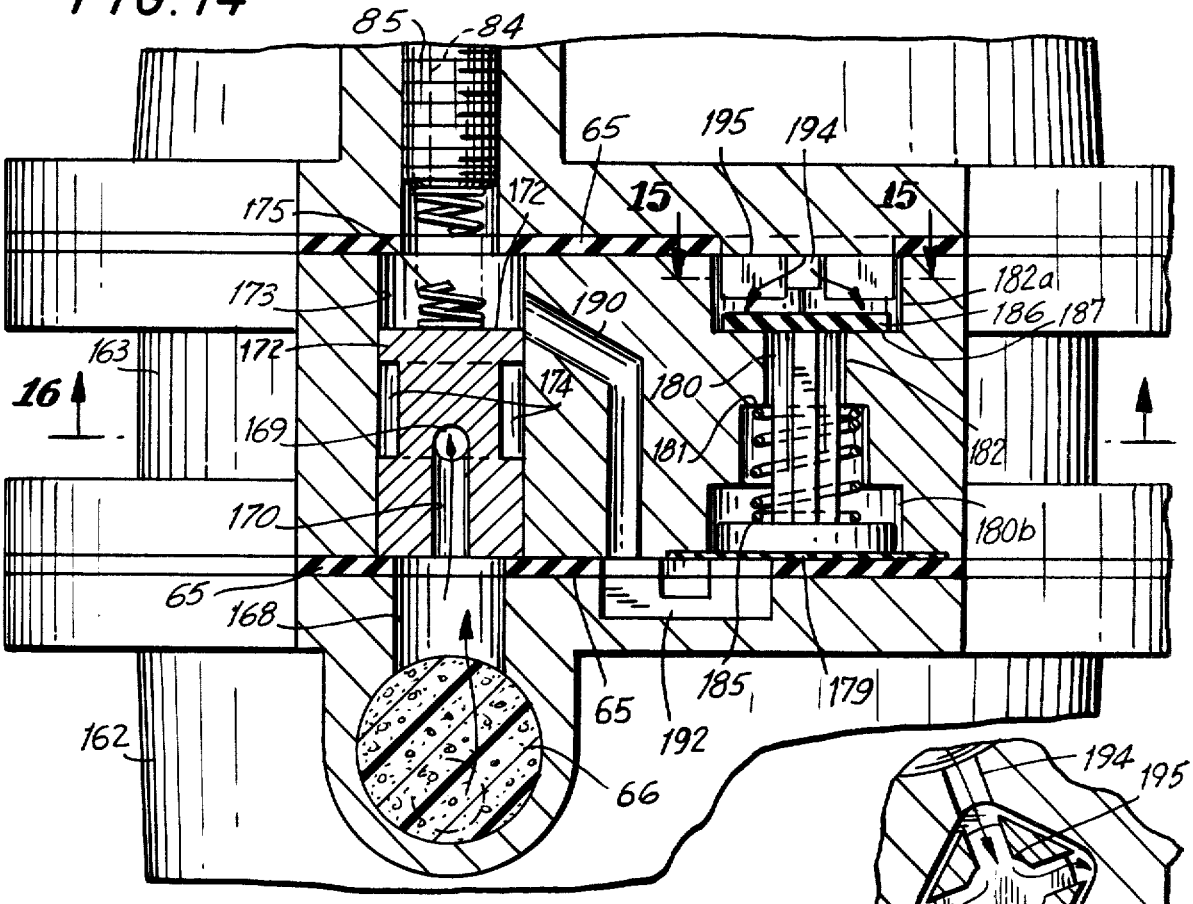
FIG. 14 is a sectional view taken along line 14—14 of FIG. 12.
Figure 15:
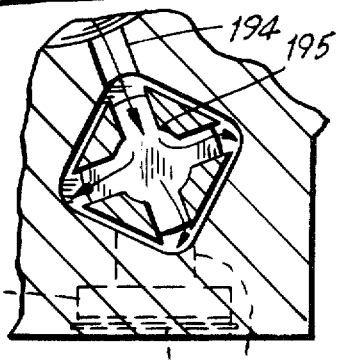
FIG. 15 is a sectional view taken along line 15—15 of FIG. 14.
Figure 16:
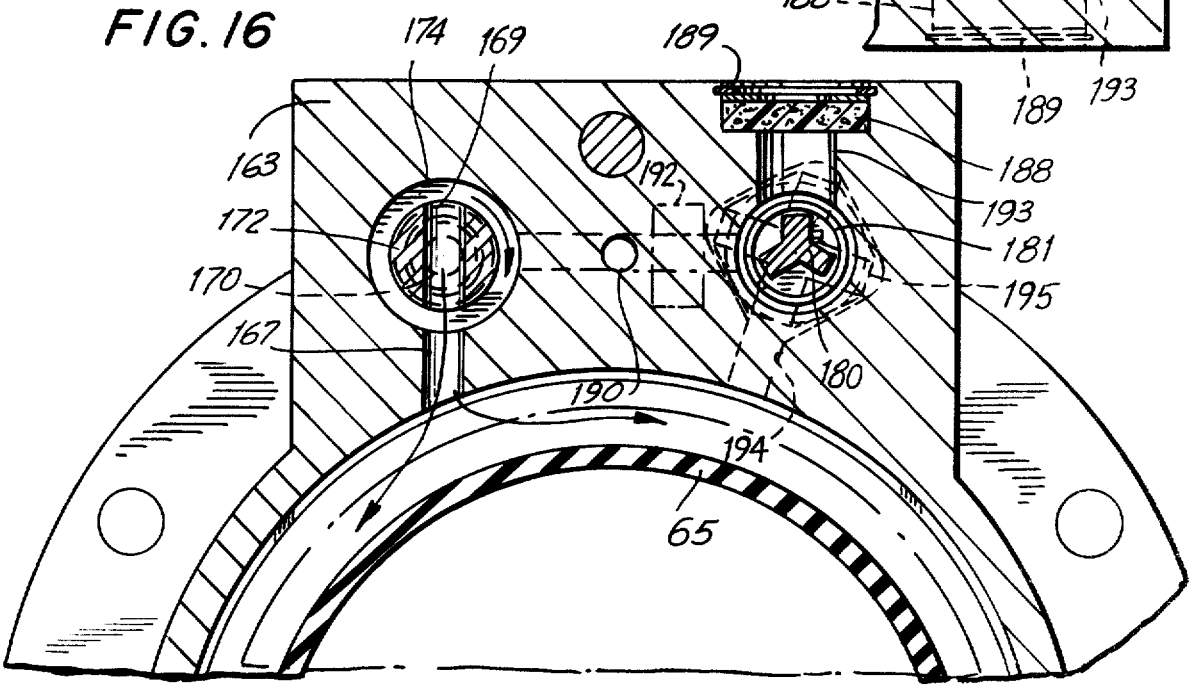
FIG. 16 is a sectional view taken along line 16—16 of FIG. 14.
Figure 18:
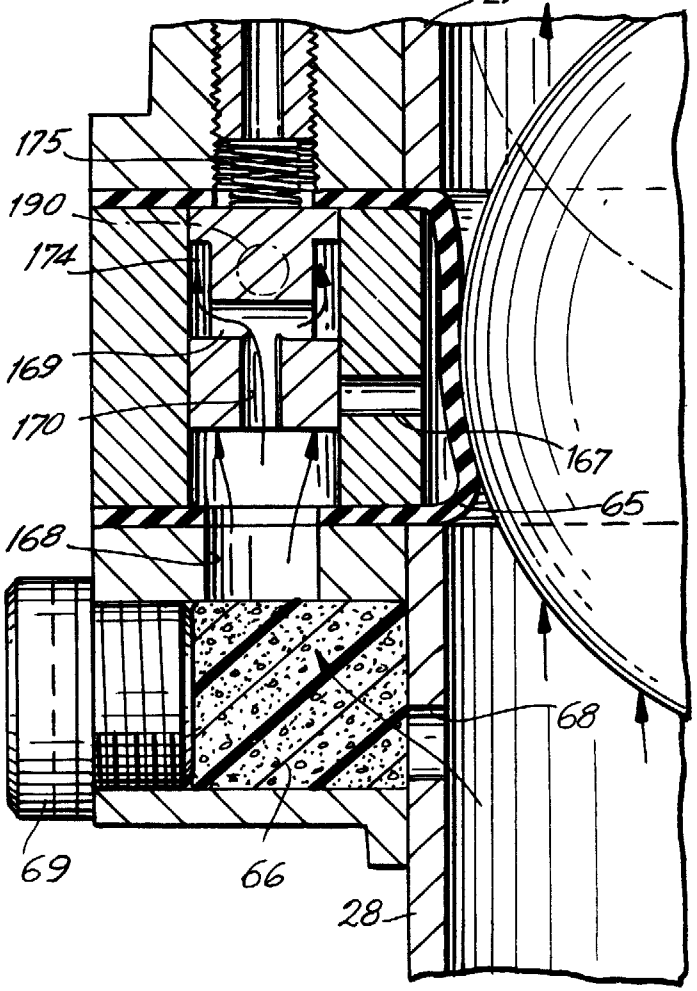
FIG. 18 is a sectional view taken along line 18—18 of FIG. 17.
Figure 17:
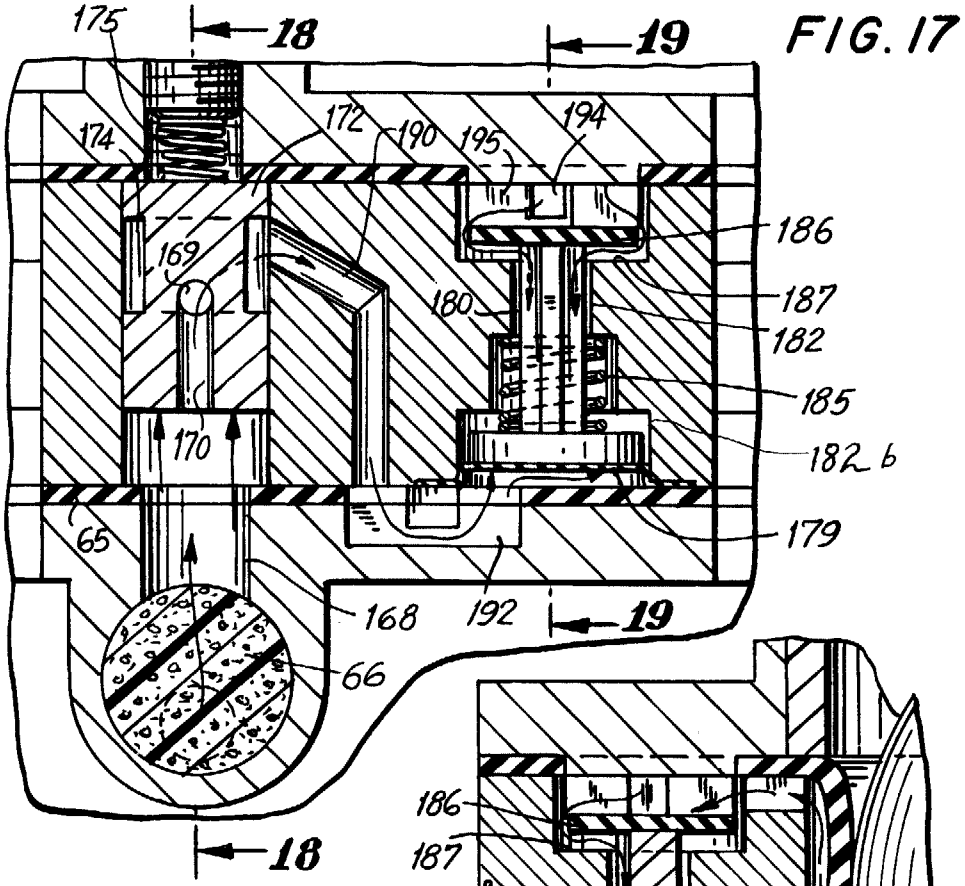
FIG. 17 is the same view as FIG. 14, showing the valves in a projecting position.
Figure 19:
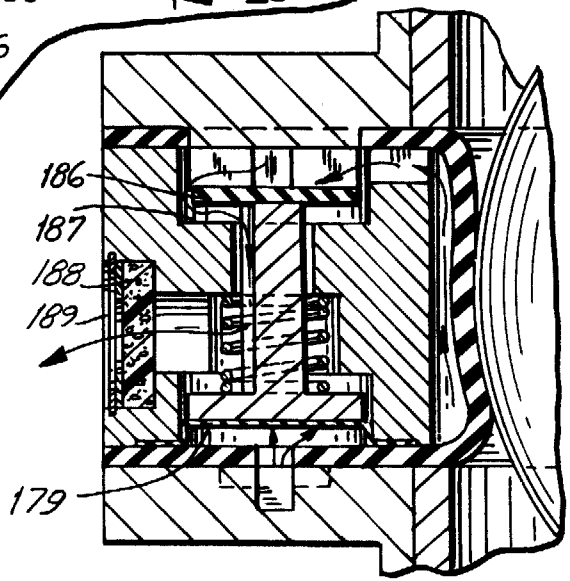
FIG. 19 is a sectional view taken along line 19—19 of FIG. 17.

As a further alternative to the soft rubber disc, a hard snap action disc, such as a Belleville spring disc formed of, for example, stainless steel can be used. Such a valve, although more complex and more expensive, would provide only the desirable fully opened or fully closed conditions, avoiding any possibility of slight "cracking" of the valve under certain circumstances. In the closed position, for example, the inner perimeter of the Belleville disc would be in contact with the valve seat 187, thereby closing off the detent volume from the atmosphere in much the same way as shown in FIG. 13. When the pressure behind the ball to be projected increases above a predetermined level, the Belleville disc will sharply snap fully open, such that the inner perimeter moves out of contact with the valve seat. The bias means, upon relaxation of the pressure behind the tennis ball, will bring the Belleville disc snapping back to its closed position.

The continuously variable nature of the bias control means shown in the drawings, or of similar types of bias control means well-known to the art, can be combined with barrel lengthening means of suitable dimensions, to obtain a continuously variable muzzle velocity for any balls to be projected over a substantially indefinite range. For example, if the barrel is to be lengthened by adding tubular members of discrete lengths, as by the tapered connection means described above, the continuously variable range of the bias control means should be substantially equal to the velocity change obtained by adding or removing a single tube length. In accordance with this procedure, the maximum velocity obtainable at the maximum biasing force for a particular length barrel should be designed to be substantially equal to the velocity obtainable at the minimum biasing force when the barrel length has been increased by one unit length.

The "pressure connecting means," as useful in accordance with the present invention, includes both direct and indirect connections. The pressure connection between, for example, the pressure chamber and the pressure responsive means, can be via a direct fluid flow connection betweeen two members, or indirectly, as by a fluid flow connection to the detent volume.

In all of the embodiments described hereinabove, the valves are depicted either as a sliding spool valve, wherein the circumferential surface acts as the valve surface, or as a disc valve. The valves are all biased towards either the open or closed positions by a helical spring acting directly on the valve member, or by a combination of a helical spring and the pressure of the fluid being checked. The valve is moved towards its second position, either closed or open, by a pressure responsive means which is mechanically directly linked to the valve member and is acted upon directly by the fluid exerting the pressure. The scope of the invention being described herein, however, is not restricted to utilizing these specific mechanical entities.

Any other types of valve means can be utilized to control the flow of fluid as required by this invention. Further, such valves can be operated and controlled by any other type of electrical, electronic, hydraulic, or other systems now known or which may be developed in the future. Further, the valve means need not be biased towards any one position, but may be held in place and moved by any other means. For example, any type of valve can be operated by an electric motor controlled indirectly by an electronic circuit energized by switching means activated by a predetermined change in pressure in the system. The valves can be maintained in the first position by any other type of biasing action, such as magnetic action, or the valve can be held in place by any positive locking action, or merely by gravity or inertia, as where the fluid does not exert force in a direction tending to move the valve. The spring-biased, direct pressure-activated valve means shown in the attached drawings are merely the preferred embodiments.

The fluid used for projecting the ball and for pressuring the detent membrane is preferably air. However, other gases, and even liquids, can be used, if desirable under any special circumstances.

The embodiments of the present invention which are claimed are as follows:

1. In a pneumatic device for projecting a ball, the device comprising a ball-directing tube defining a generally tubular inner space; gas pressure supply means operatively connected to a first end of the tube to provide gas under pressure thereto; means for feeding a ball into the tube for movement along the tubular inner space in a direction from the first end of the tube toward the second end of the tube; and detent means in the tube for transiently restraining the movement of a ball therethrough, the improvement comprising providing a pneumatically operated detent means, the detent means comprises:

an inflatable member within said tube, the member having a first inflated configuration extending into the tubular inner space, defining a substantially pressure-tight detent volume, so as to constrict the tubular inner space and thus restrain the movement of a ball therealong, and a second, deflated configuration, permitting the movement of a ball along the tubular inner space;

a pressure chamber, the gas pressure in such pressure chamber being increased when a ball is in place in the tubular inner space and is restrained by the detent member in the inflated configuration, while gas under pressure is being provided to the first end of the tube;

pressure valve means between the detent volume, and the pressure chamber;

pressure bias means operatively connected to the pressure valve means to bias the pressure valve means towards an open position;

a first pressure-responsive member operatively connected to the pressure valve means and acting against the bias means, tending to move the pressure valve means towards a closed position;

exhaust valve means between the detent volume and atmosphere;

exhaust bias means operatively connected to the exhaust valve means to bias the exhaust valve means towards a closed position;

a second pressure-responsive member operatively connected to the exhaust valve means and acting against the exhaust bias means, tending to move the exhaust valve means towards an open position; and pressure-connecting means between the pressure-responsive members and the pressure chamber;

whereby at a predetermined pressure in the pressure chamber, the pressure valve means is moved into the closed position, and the exhaust valve means is moved into the open position, so as to substantially immediately permit the deflation of the inflatable member when a ball is pressed thereagainst and permit passage of the ball along the tubular inner space.

2. The pneumatic device of claim 1 wherein the gas pressure supply means is an air compressing means having inlet means in fluid flow connection to the atmosphere and outlet means in fluid flow connection to the first end of the tube.

3. The device of claim 2 wherein the inflatable member is in the form of an annular membrane which defines an annular detent volume within the tubular inner space.

4. The pneumatic device in accordance with claim 3, wherein the pressure chamber comprises the tubular inner space between the detained ball and the gas pressure supply means.

5. The pneumatic device in accordance with claim 4, wherein the pressure within the pressure chamber is substantially equal to the pressure within the detent volume defined by the detent membrane when the pressure valve means is in the open position.

6. The pneumatic device in accordance with claim 3, wherein the pressure bias means comprises a spring member.

7. The pneumatic device in accordance with claim 6, wherein the exhaust bias means comprises a spring member.

8. The pneumatic device of claim 1 comprising, in addition, regulating means for the velocity of a ball projected from the second end of the tube, the regulating means comprising means to vary the length of the ball-directing tube between the detent means and the second end of the tube, whereby the greater the length of the tube, the greater the velocity of the projected ball leaving the tube.

9. The pneumatic device of claim 1 comprising, in addition, filter means between pressure valve means and the pressure chamber.

10. The pneumatic device of claim 9 comprising, in addition, filter means between the exhaust valve means and atmosphere.

11. The pneumatic device of claim 1, wherein the inflatable member is an annular, elastically biased membrane which defines an annular detent volume within the tubular inner space, the membrane being biased towards the inflated configuration.

12. The pneumatic device of claim 1, comprising bias control means, operatively connected to the pressure bias means for varying the force exerted by the bias means, whereby the predetermined pressure for closing the pressure valve means can be varied to control the velocity at which the ball is projected.

13. The pneumatic device of claim 1, comprising an exhaust connecting valve in the pressure-connecting means between the pressure chamber and the second pressure responsive member, the exhaust connecting valve being arranged so that it is closed when the pressure valve means are open.

14. The pneumatic device of claim 13, wherein the exhaust connecting valve is arranged so that the pressure in the pressure chamber required to open the exhaust connecting valve at least equals the pressure required to close the pressure valve.

15. In a pneumatic device for projecting a ball, the device comprising a ball-directing tube defining a generally tubular inner space, gas pressure supply means operatively connected to a first end of the tube to provide gas under pressure thereto, means for feeding a ball into the tube for movement along the tubular inner space in a direction from the first end of the tube toward the second end of the tube, and detent means in the tube for transiently restraining the movement of a ball therethrough, the improvement comprising:

providing pressure-regulated, pneumatically operated detent means, the detent means comprising:

an inflatable member within said tube, the member having a first inflated configuration extending into the tubular inner space, defining a substantially pressure-tight detent volume, so as to constrict the tubular inner space and thus restrain the movement of a ball therethrough, and a second deflated configuration permitting the movement of a ball along the tubular inner space;

a pressure chamber, the gas pressure in such pressure chamber being increased when a ball is in place in the tubular inner space and is restrained by the detent member in the inflated configuration, while gas under pressure is being provided to the first end of the tube;

pressure valve means between the detent volume and the pressure chamber;

exhaust valve means between the detent volume and atmosphere;

bias means operatively connected to the pressure valve means and to the exhaust valve means to bias the pressure valve means towards an open position and to bias the exhaust valve means towards a closed position;

pressure-responsive means operatively connected to the pressure valve means and to the exhaust valve means and acting against the bias means, tending to move the pressure valve means into a closed position and the exhaust valve means into an open position; and pressure-connecting means between the pressure-responsive means and the pressure chamber;

whereby, increasing the pressure in the chamber to a pre-determined value causes the pressure valve means to close and the exhaust valve means to open, thus causing the detent means to deflate and to permit the ball to move along the tubular inner volume.

16. The device of claim 15, wherein the inflatable member is an elastically-biased membrane in the form of an annular ring which defines an annular detent volume within the tubular space.

17. The pneumatic device of claim 16, wherein the gas pressure within the pressure chamber is substantially equal to the pressure in the detent volume defined by the detent membrane when the pressure valve means is in the opened position.

18. The pneumatic device of claim 17, wherein the pressure chamber comprises the tubular inner space between the detained ball and the gas pressure supply means.

19. The pneumatic device of claim 18, comprising a single valve member, wherein the pressure valve means and exhaust valve means each comprise a surface on the single valve member and the pressure responsive means comprises a surface on the single valve member.

20. The pneumatic device of claim 19, wherein the bias means comprises a spring member operatively connected to the valve member.

21. The pneumatic device of claim 20, comprising control means for the bias means for varying the force exerted by the bias means on the pressure valve member.

22. The pneumatic device of claim 21, wherein the control means for the variable bias means comprises a longitudinal, rigid member, axially reciprocally movable and juxtaposed against the spring so as to restrain the spring member between the valve member and the control means.

23. The pneumatic device of claim 15, wherein the pressure valve means comprises a surface of a first valve member and the exhaust valve means comprises a surface on a second member.

24. The pneumatic device of claim 23, wherein the pressure-responsive means comprises a third surface, operatively connected to the first valve member and in direct fluid contact with the gas in the pressure chamber, and a fourth surface operatively connected to the second valve member and in fluid pressure connection with the pressure chamber.

25. The pneumatic device of claim 24, comprising an intermediate valve means between the fourth surface and the pressure chamber, the intermediate valve means being operatively connected to the pressure valve means and so arranged that the intermediate valve means is open only when the pressure valve means is closed, whereby the fourth surface is out of fluid pressure connection with the pressure chamber when the pressure valve means is open.

26. The pneumatic device of claim 25, comprising a fluid-tight flexible diaphragm, having two opposing sides, operatively connected to the fourth surface on one side thereof and in fluid pressure connection with the pressure chamber on the second side thereof, whereby the exhaust valve member is not directly exposed to the fluid within the pressure chamber and such fluid cannot pass through the exhaust valve member.

27. In a pneumatic device for projecting a ball, the device comprising a ball-directing tube defining a generally tubular inner space, gas pressure supply means operatively connected to a first end of the tube to provide gas under pressure thereto, means for feeding a ball into the tube for movement along the tubular inner space in a direction from the first end of the tube toward the second end of the tube, and detent means in the tube for transiently restraining the movement of a ball therethrough, the improvement comprising a pneumatic detent means comprising:

an inflatable member within said tube, the member having a first inflated configuration extending into the tubular inner space, defining a substantially pressure-tight detent volume, so as to constrict the tubular inner space and thus restrain the movement of a ball therethrough, and a second deflated configuration permitting the movement of a ball along the tubular inner space;

a pressure chamber, the gas pressure in such pressure chamber being increased when gas pressure is provided to the first end of the tube while a ball is in place in the tubular inner space and is restrained by the detent member in the inflated configuration;

pressure valve means between the detent volume and the pressure chamber;

exhaust valve means between the detent volume and atmosphere;

pressure securing means operatively connected to the pressure valve means to secure the pressure valve means in an open position and exhaust securing means to maintain the exhaust valve means in a closed position;

pressure responsive means operatively connected to the pressure valve means and to the exhaust valve means, tending to overcome the pressure valve securing means and to move the pressure valve means into a closed position and tending to overcome the exhaust valve securing means and to move the exhaust valve means into an open position, the pressure responsive means being in a pressure sensing relationship with the fluid in the pressure chamber;

whereby increasing the pressure in the pressure chamber to a predetermined value causes the pressure valve means to close and the exhaust valve means to open, thus causing the detent means to deflate and to permit the movement of a ball along the tubular inner surface.

28. A pneumatic device for projecting a ball, the device comprising a ball-directing tube defining a generally tubular inner space; air compressing means having inlet means in fluid flow connection to the atmosphere and outlet means in fluid flow connection to the first end of the tube; means for feeding a ball into the tube for movement along the tubular inner space in a direction from the first end of the tube towards the second end of the tube;

an inflatable annular membrane, defining an annular detent volume within the tubular inner space, the inflatable membrane having a first inflated configuration extending into the tubular inner space, defining a substantially pressure-tight detent volume, so as to constrict the tubular inner space and thus restrain the movement of a ball therealong, and a second, deflated configuration, permitting the movement of a ball along the tubular inner space, the membrane being elastically biased towards the inflated configuration;

the tubular inner space between the first end of the tube and the detent membrane defining a pressure chamber wherein the gas pressure is increased when a ball is restrained by the detent membrane in the inflated configuration, while gas under pressure is provided from the air compressing means;

a first fluid flow channel between the pressure chamber and the detent volume;

a pressure valve in the first channel between the detent volume and the pressure chamber comprising a pressure valve member;

a spring pressure member operatively connected to the pressure valve member to bias the pressure valve member towards an open valve position;

a second fluid flow channel between the detent volume and atmosphere;

an exhaust valve between the detent volume and atmosphere comprising an exhaust valve member;

a spring exhaust member operatively connected to the exhaust valve member to bias the exhaust valve member towards a closed valve position;

a first pressure surface on the pressure valve member, so disposed that positive pressure exerted against such pressure surface tends to move the pressure valve member against the bias spring force;

a third flow channel between the pressure chamber and the first pressure surface;

a fourth fluid flow channel between the exhaust valve member and the pressure chamber;

one valve surface of the pressure valve member being transiently interposable within the fourth fluid flow channel, so disposed that the valve surface closes off fluid flow through the fourth channel when the pressure valve member is in the open position; and a fluid impermeable, pressure-tight flexible membrane operatively connected with the exhaust valve member, the flexible membrane being so disposed as to prevent the passage of fluid between the exhaust valve member and the pressure chamber and move the exhaust valve member in response to pressure in the fourth channel, against the spring bias force;

whereby at a predetermined pressure in the pressure chamber, the pressure valve means is moved into the closed position and the exhaust valve means is moved into the open position, so as to substantially immediately permit the deflation of the inflatable member when a ball is pressed thereagainst and permit passage of the ball along the tubular inner space.

29. In a pneumatic device for projecting a ball, the device comprising a ball-directing tube defining a generally tubular inner space, gas pressure supply means operatively connected to a first end of the tube to provide gas under pressure thereto, means for feeding a ball into the tube for movement along the tubular inner space in a direction from the first end of the tube toward the second end of the tube, and detent means in the tube for transiently restraining the movement of a ball therethrough until a predetermined pressure is developed behind the ball, the improvement comprising pressure-operated detent means comprising:

an inflatable member within said tube, the member having a first inflated configuration extending into the tubular inner space, defining a substantially pressure-tight detent volume, so as to constrict the tubular inner space and thus restrain the movement of a ball therethrough, and a second deflated configuration permitting the movement of a ball along the tubular inner space;

fluid flow channel connecting means between the gas pressure supply means and the detent volume for increasing the gas pressure within such detent volume as the gas pressure behind the ball is increased;

exhaust means for releasing the fluid pressure within the detent volume when the gas pressure behind the detained ball reaches a predetermined value; and a gas valve in the fluid flow channel connecting means, designed to prevent fluid flow between the supply means the the detent volume when the exhaust means releases the fluid pressure, whereby the detent means deflates thus releasing the ball for movement along the tubular inner surface, the ball being projected by the gas pressure developed therebehind.

* * * * *